US005883342A

United States Patent [19]

Wölpert

[11] Patent Number: 5,883,342

[45] Date of Patent: Mar. 16, 1999

[54] MUFFLING DEVICE FOR COMBUSTION ENGINES

[75] Inventor: Gustav Wölpert, Waiblingen, Germany

[73] Assignee: Andreas Stihl AG & Co., Waiblingen, Germany

[21] Appl. No.: 862,606

[22] Filed: May 23, 1997

[30] Foreign Application Priority Data

May 25, 1996 [DE] Germany ..... 296 09 405 U

[51] Int. Cl.[6] ..... F01N 3/02

[52] U.S. Cl. ..... 181/230; 181/231

[58] Field of Search ..... 181/230, 231, 181/255, 269, 282, 240

[56] References Cited

U.S. PATENT DOCUMENTS

| | | | |
|---|---|---|---|
| 2,152,205 | 3/1939 | Morrison | 181/230 |
| 2,838,129 | 6/1958 | Hesse et al. | 181/230 |
| 4,142,607 | 3/1979 | Landwehr et al. | 181/240 |
| 4,231,221 | 11/1980 | Mathner et al. | 181/230 |

FOREIGN PATENT DOCUMENTS 2638203 3/1978 Germany .

*Primary Examiner*—Khanh Dang
*Attorney, Agent, or Firm*—Robert W. Becker & Associates

[57] ABSTRACT

A muffling device for a combustion engine of a hand-guided working tool has at least one housing member with at least one outlet opening for exhaust gas. An elongate cover member is positioned above the outlet opening for deflecting the exhaust gas into a main flow direction. The cover member has a longitudinal extension in the main flow direction. The cover member has a first end face with a main exhaust gas opening in the main flow direction through which a main exhaust gas stream exits into the surrounding atmosphere. The cover member has at least one lateral wall with at least one auxiliary exhaust gas opening through which a partial or auxiliary exhaust gas stream exits.

16 Claims, 3 Drawing Sheets

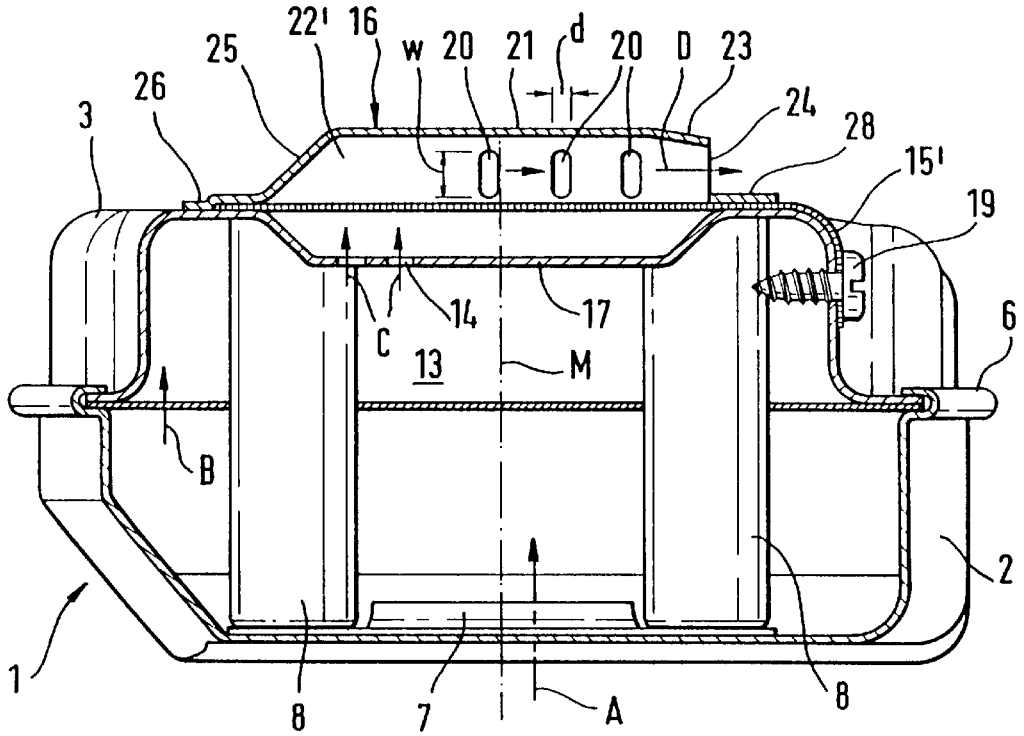
Fig. 2
Fig. 3
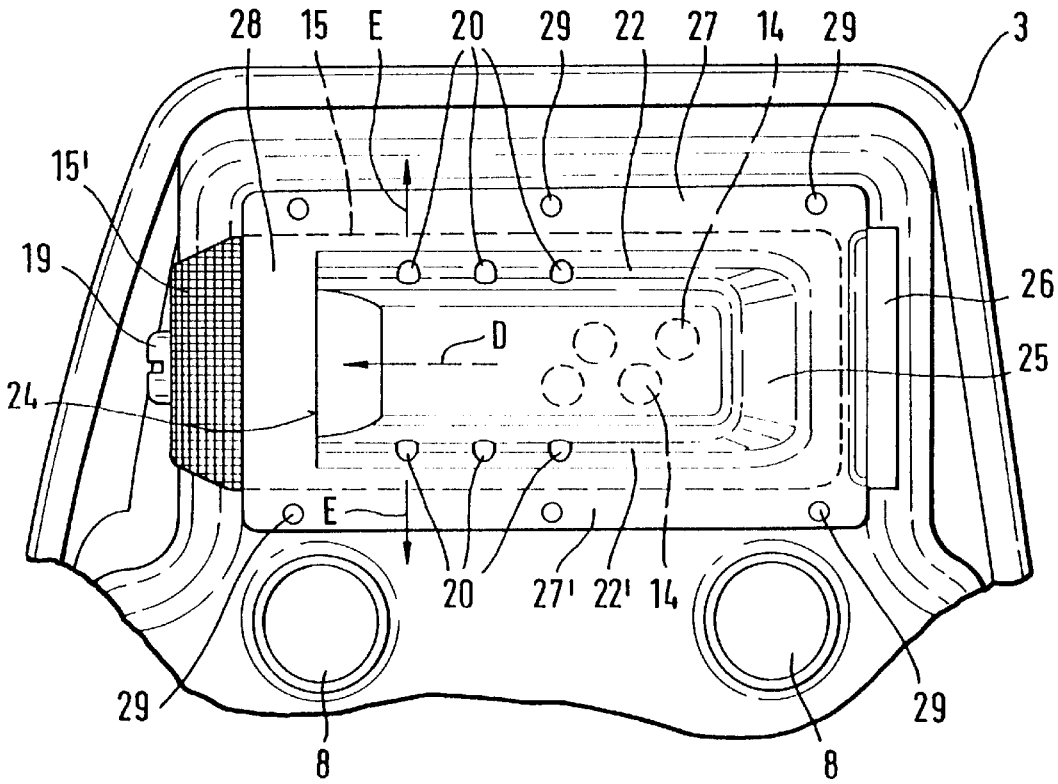

MUFFLING DEVICE FOR COMBUSTION ENGINES

BACKGROUND OF THE INVENTION

The present invention relates to a muffling device for combustion engines, especially for two stroke engines of hand-guided working tools such as motor chainsaws, trimmers etc. Such as muffling device comprises at least one housing member with at least one outlet opening for the exhaust gas whereby a cover member covers the outlet opening for deflecting the exhaust gas stream.

From German Offenlegungsschrift 26 38 203 a muffling device for small engines is known which is comprised of a lower and an upper housing member detachably connected to one another. The exhaust gas is guided through a tube extending into the lower housing member and can exit through openings in the upper housing member. The openings are in the form of longitudinal slots and are covered by a cover member that deflects the exhaust gas.

Due to the small constructive size that such a muffling device should have, the exhaust gas flow path within the muffling device is relatively short so that the exhaust gas at the exit location into the surrounding atmosphere has a very high exhaust gas temperature. Exhaust gas streams of such high temperatures are very uncomfortable for the operator. Furthermore, very strict specifications are placed on working tools that are, for example, used in forestry, especially with respect to the exhaust gas temperature in a measuring plane in the vicinity of the exhaust gas muffling device. Furthermore, a housing part of the working tool that bridges the exhaust gas muffling device and is provided with venting slots should not be exposed to excessive temperature loads.

It is therefore an object of the present invention to improve a muffling device for combustion engines of the aforementioned kind such that with simple means and without greater expenditures a reduction of the exhaust gas temperature can be achieved.

SUMMARY OF THE INVENTION

A muffling device for a combustion engine of a hand-guided working tool is primarily characterized by:

At least one housing member having at least one outlet opening for the exhaust gas;

An elongate cover member positioned above the outlet opening for deflecting the exhaust gas into a main flow direction;

The cover member having a longitudinal extension in the main flow direction;

The cover member having a first end face with a main exhaust gas opening in the main flow direction through which a main exhaust gas stream exits into the surrounding atmosphere;

The cover member having at least one lateral wall with at least one auxiliary exhaust gas opening through which a partial exhaust gas stream exits.

Preferably, the cover member has two lateral walls.

The auxiliary exhaust gas openings are preferably uniformly arranged relative to a longitudinal axis of the cover member. The auxiliary exhaust gas openings are preferably symmetrically arranged.

Advantageously, the auxiliary exhaust gas openings are circular holes. It is also possible to provide the auxiliary exhaust gas openings in the form of slotted holes.

Expediently, the slotted holes have a longitudinal axis, and the longitudinal axis of the slotted holes extends perpendicular to the main flow direction.

The cover member expediently has a top portion. The top portion has arc-shaped transitions into the lateral walls. The slotted holes extend in a direction of their longitudinal axis into the vicinity of the arc-shaped transitions.

The slotted holes have a louver structure.

The at least one auxiliary exhaust gas opening is preferably a stamped hole.

The auxiliary exhaust gas openings are positioned in an area of the lateral walls defined between a center portion of the cover member and the main exhaust gas opening.

The cover member preferably has a substantially planar top portion having a first end adjacent to the main exhaust gas opening, wherein the first end is slanted downwardly.

The muffling device preferably further comprises a spark protection screen positioned between the at least one outlet opening and the cover member and covering the at least one outlet opening.

The cover member preferably comprises bottom edge portions at the lateral walls and at a second end face opposite the main exhaust gas opening. The bottom edge portions project outwardly past the spark protection screen.

The bottom edges at the lateral walls of the cover member are connected to the at least one housing member by spot welds.

The spark protection screen advantageously has an extension projecting outwardly from the cover member at the first end face and fastened to the at least one housing member by a screw.

The important advantages of the invention are that at a plurality of locations partial exhaust gas streams can exit from the cover member so as to be turbulently mixed with a large amount of fresh air. Due to the considerable temperature difference between the fresh air and the exhaust gas, this results in a considerable lowering of the temperature level already along a short flow path. The exit velocity of the main exhaust gas stream is substantially reduced so that, relative to the flow path length, a fast and intensive mixing with fresh air occurs.

In an especially simple manner it is possible to guide exhaust gas into the fresh air surrounding the cover member through at least one auxiliary exhaust gas opening in the lateral walls of the cover member. In order to achieve a very strong turbulence and mixing of fresh air and exhaust gas, it is however expedient that at both lateral walls such auxiliary exhaust gas openings are provided. In order to ensure stiffness of the cover member, the lateral walls are provided with auxiliary exhaust gas openings having a limited width in the exhaust gas flow direction. For example, auxiliary exhaust gas openings with a circular cross-section of a diameter of 2.5 mm maximum are suitable. Especially preferred is an embodiment of the auxiliary exhaust gas openings as slotted holes having a width between their longitudinal sides of approximately 2 mm. These slotted holes can be arranged with their longitudinal axis at a slant to the main flow direction of the exhaust gas. Especially suitable, however, is an arrangement of the longitudinal axis of the slotted holes transverse to the direction of the exhaust gas flow. Preferably, the length of the slotted holes in their longitudinal direction is such that the slotted holes end at the lower edge of an arc-shaped transition of the top portion of the cover member into the lateral walls. In this manner, it is achieved that a certain predetermined exit flow behavior is imparted to the auxiliary (partial) exhaust gas stream exiting from the auxiliary exhaust gas openings.

In an especially simple embodiment, the auxiliary exhaust gas openings can be embodied as stamped holes. In the alternative, however, it is possible to provide the auxiliary exhaust gas openings with louver structures. Since the exhaust gas stream upstream of the auxiliary exhaust gas openings within the cover member is subjected to a deflection of 90°, the auxiliary exhaust gas openings should be provided in an area of the cover member in which the main flow direction of the exhaust gas stream is stable. Expediently, the auxiliary exhaust gas openings are therefore arranged in an area of the cover member that is located between a central portion of the longitudinal extension of the cover member and the main exhaust gas opening at the first end face of the cover member. The top portion of the cover member is preferably substantially planar, but in the vicinity of the main exhaust gas opening at the first end face of the cover member the top portion is provided with a first end that is downwardly slanted. This measure also reduces the exit velocity of the main exhaust gas stream.

In order to prevent flying sparks exiting with the exhaust gas, a spark protection screen covering the outlet opening is provided in the form of a wire mesh between the cover member and the outlet opening of the housing member of the muffling device. The cover member is preferably provided along its longitudinal sides (lateral walls) and the closed (second) end face with bottom edge portions that extend outwardly past the spark protection screen. Thus, the bottom edge portion rest at the exterior side of the housing member so that the cover member can be fastened at the housing member by spot welding in the area of the bottom edge portions. At the first end face of the cover member having the main exhaust gas opening, the spark protection screen has an extension which is fastened with a screw to the housing member.

BRIEF DESCRIPTION OF THE DRAWINGS

The object and advantages of the present invention will appear more clearly from the following specification in conjunction with the accompanying drawings, in which:

FIG. 2 is a section along the line II—II of FIG. 1;

FIG. 3 is a view of the cover member in the direction of arrow III in FIG. 1.

DESCRIPTION OF PREFERRED EMBODIMENTS

The present invention will now be described in detail with the aid of several specific embodiments utilizing FIGS. 1 through 4.

Figure 1:
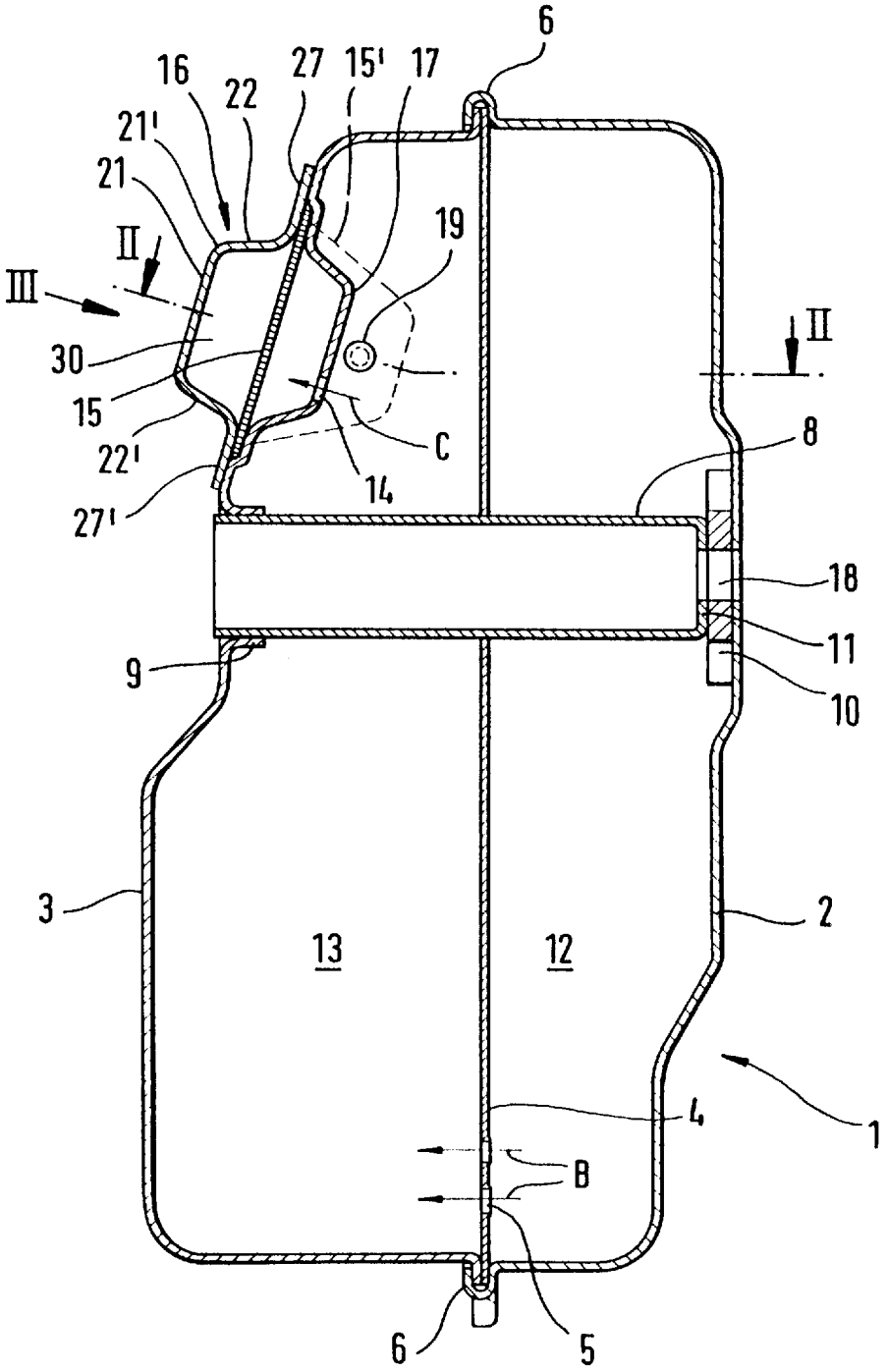
FIG. 1 is a longitudinal section of a muffling device.

FIG. 1 shows a muffling device 1 the housing of which is comprised of two housing members 2 and 3, i.e., the inlet housing member 2 and the outlet housing member 3. Within the muffling device 1 a partition 4 is provided between the housing members 2 and 3. The outer circumference of the partition 4 is clamped between the edges of the housing members 2 and 3. The housing members 2 and 3 are connected to a closed and tight housing by a crimping connection 6 with the partition being interposed. A plurality of through openings 5 are provided within the partition 4. The inlet chamber 12, delimited by the partition 4 and the inlet housing member 2, is connected by the openings 5 to the outlet chamber 13, delimited by the partition 4 and the housing member 3. According to the arrow B the exhaust gas flows from the inlet chamber 12 into the outlet chamber 13. Two tubular bodies (tubes) 8, positioned perpendicularly to the partition 4, extend through the inlet chamber 12 and the outlet chamber 13. Due to the cross-sectional representation of FIG. 1 only one tube 8 can be seen in FIG. 1. The tube 8 comprises an annular collar 11 at the side facing the inlet housing member 2 which is connected to the housing member 2 with interposition of a stiffening flange 10. The end of the tube 8 facing the housing member 3 is guided by an annular flange 9 of the housing member 3 and is sealingly surrounded by it. Within the stiffening flange 10 a bore 18 is provided which allows penetration by a fastening screw for the attachment of the muffling device 1 to the combustion engine. The head of the screw cooperates with the annular flange 11. In this manner, a short screw connection of the muffling device 1 to the combustion engine is possible.

The housing member 3 is provided with an inwardly extending depression 17 at the upper side thereof (see FIG. 1). In the depression 17 the outlet openings 14 are provided whereby only one of the outlet openings 14 is shown in FIG. 1. Above the depression 17 a cover member 16 is arranged. Its top portion 21 and lateral walls 22 form an exit channel 30. The top portion 21 comprises along the longitudinal sides arc-shaped transitions 21' extending into the lateral walls 22. The cover member 16 is provided with lateral bottom edge portions 27, 27' with which the cover member 16 rests on the housing member 3. The lateral bottom edge portions 27, 27' are connected to the housing member 3 by welding. Between the housing member 3 and the lateral edge portions 27, 27' of the cover member 16 a spark protection screen 15 is clamped. It extends at a distance to the depression 17 as well as to the top portion 21 of the cover member 16. The exhaust gas stream exiting from the outlet openings 14 in the direction of arrow C is thus guided through the spark protection screen 15 into the exit channel 30. The spark protection screen 15 prevents sparks from exiting with the exhaust gas stream. As will be explained in the following with the aid of further drawings, the spark protection screen 15 has an extension 15' which is fastened by a screw 19 at the housing member 3.

FIG. 2 shows a section along the line II—II of FIG. 1. From this representation it can be taken that the muffling device 1 is penetrated by two tubular bodies (tubes) 8. Between the ends neighboring the housing member 2 an inlet opening 7 is provided in the housing member 2 through which the exhaust gas stream, coming from the cylinder of the combustion engine, enters the inlet chamber 12 in the direction of arrow A. The exhaust gas stream flows in the direction of arrow B, as disclosed in connection with FIG. 1, into the outlet chamber 13. As can be seen in more detail in FIG. 2, the depression 17 of the housing member 3 has an elongate extension, and the shape of the cover member 16 matches the length of the depression 17. The outlet openings (14 not visible in FIG. 2) within the depression 17 are positioned substantially to the left of the center line M in FIG. 2.

The cover member 16 has a second end face 25 extending into an edge 26. At the opposite end (the first end face) of the cover member 16, the main exhaust gas opening 24 is provided. The main exhaust gas stream exits in the direction arrow D through opening 24 into the surrounding air. At the first end face of the cover member 16, in which the opening 24 is provided, a forward edge 28 extends across the extension 15'. The extension 15' of the spark protection screen 15 is connected with a sheet metal screw 19 at the housing member 3. By loosening the screw 19, the spark protection screen 15 can be exchanged because the lateral edges of the spark protection screen 15 are displacable between the housing member 3 and the cover member 16.

As can be seen in FIG. 2, the lateral walls 22 of the cover member 16 are provided with auxiliary exhaust gas outlet openings 20 which are in the form of stamped, slotted holes the longitudinal extension of which is transverse to the orientation of the main flow direction D. The auxiliary exhaust gas openings 20 have, because of their shape, two parallel longitudinal sides. The distance between the longitudinal sides is approximately 2 mm. Of course, the distance d can be of different values, whereby the upper limit is a maximum of 2.5 mm. With respect to the direction of the longitudinal extension of the slotted holes, variations are possible, for example, a slanted arrangement relative to the main flow direction D is possible. As shown in the embodiment of FIG. 2, the length w of the slotted holes 20 in their longitudinal direction is such that they end at the arc-shaped transition 21'.

The top portion 21 of the cover member 16 is provided directly upstream of the main exhaust gas opening 24 with a downwardly slanted first end 23. The slant angle is minimal. This first end 23 causes a reduction of the flow velocity of the main exhaust gas stream in the main flow direction D. The exhaust gas stream, entering in the direction of arrow C the interior of the cover member 16, is deflected within the cover member 16 by an angle of 90° and continues in the direction of arrow D (main flow direction). Due to the high pressure within the cover member 16, the exhaust gas not only flows through the main exhaust gas opening 24 but also through the auxiliary exhaust gas openings 20. Thus, a main exhaust gas stream in the main flow direction D and a plurality of auxiliary (partial) exhaust gas streams result (arrow E) so that a large amount of fresh air is mixed with the hot exhaust gas. Due to the great temperature difference between fresh air and the exhaust gas stream, which may be more than 300° C., a drastic reduction of the temperature of the mixture of exhaust gas and air exiting into the surrounding atmosphere is possible already shortly downstream of the cover member 16. The inventive measure may result in a reduction of the exhaust gas temperature within the measuring plane by a magnitude of 80° to 100° C.

From the representation of FIG. 3 it can be taken that the cover member 16, relative to the main flow direction D of the main exhaust gas stream, is symmetrical. Since in FIG. 3 the cover member 16 has at its right side the closed end face 25 and at the left side the main exhaust gas opening 24 for allowing exit of the exhaust gas into the surrounding atmosphere (air), the outlet openings 14 provided within the depression 17 are positioned in the area adjacent to the end face 25. The auxiliary exhaust gas openings 20 which are provided in the lateral wall 22 as well as in the lateral wall 22' are positioned within that half of the cover member 16 which is adjacent to the main exhaust gas opening 24 at the first end face. As can be seen in FIG. 3, the bottom edge portions 26 and 27, 27' of the cover member 16 project past the spark protection screen 15. A connection between the housing member 3 and the cover member 16 is provided by spot welds 29 at the edges 27, 27'. The arrows E indicate the exit direction of the auxiliary (partial) exhaust gas stream. However, depending on the embodiment of the openings 20, the exit direction may also be such that an acute angle exists relative to the main flow direction D.

Figure 4:
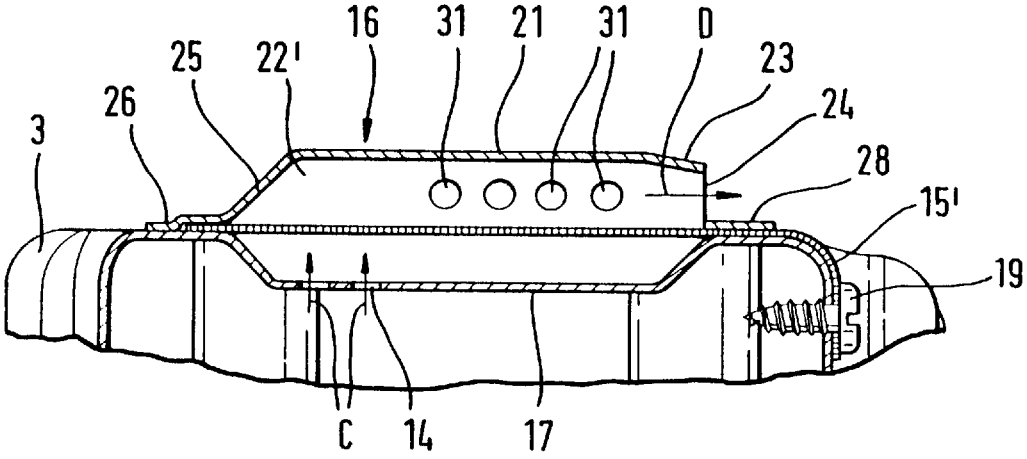
FIG. 4 shows a further embodiment of the cover member.

FIG. 4 shows a further embodiment of the cover member 16. This cover member 16, in contrast to the cover member 16 of FIGS. 1 through 3, has auxiliary exhaust gas openings 31 of a circular cross-section. Otherwise, the features and reference numerals are identical to the embodiment of FIGS. 1 through 3.

The present invention is, of course, in no way restricted to the specific disclosure of the specification and drawings, but also encompasses any modifications within the scope of the appended claims.

What I claim is:

1. A muffling device for a combustion engine of a hand-guided working tool, said muffling device comprising:

at least one housing member having at least one outlet opening for exhaust gas;

an elongate cover member positioned above said outlet opening for deflecting the exhaust gas into a main flow direction;

said cover member having a longitudinal extension in said main flow direction;

said cover member having a first end face with a main exhaust gas opening in said main flow direction through which a main exhaust gas stream exits into the surrounding atmosphere;

said cover member having at least one lateral wall extending parallel to said main flow direction, wherein said at least one lateral wall has at least one auxiliary exhaust gas opening through which a partial exhaust gas stream exits to reduce the exhaust gas temperature.

2. A muffling device according to claim 1, wherein said cover member has two of said lateral walls.

3. A muffling device according to claim 2, wherein said auxiliary exhaust gas openings are uniformly arranged relative to a longitudinal axis of said cover member.

4. A muffling device according to claim 3, wherein said auxiliary exhaust gas openings are symmetrically arranged.

5. A muffling device according to claim 2, wherein said auxiliary exhaust gas openings are circular holes.

6. A muffling device according to claim 2, wherein said auxiliary exhaust gas openings are slotted holes.

7. A muffling device according to claim 6, wherein said slotted holes have a longitudinal axis and wherein said longitudinal axis of said slotted holes extend perpendicular to said main flow direction.

8. A muffling device according to claim 7, wherein:

said cover member has a top portion;

said top portion has arc-shaped transitions into said lateral walls; and said slotted holes extend in a direction of said longitudinal axis into the vicinity of said arc-shaped transitions.

9. A muffling device according to claim 7, wherein said slotted holes have a louver structure.

10. A muffling device according to claim 2, wherein said at least one auxiliary exhaust gas opening is a stamped hole.

11. A muffling device according to claim 2, wherein said auxiliary exhaust gas openings are positioned in an area of said lateral walls defined between a center portion of said cover member and said main exhaust gas opening.

12. A muffling device according to claim 2, wherein said cover member has a substantially planar top portion having a first end adjacent to said main exhaust gas opening, said first end slanted downwardly.

13. A muffling device according to claim 2, further comprising a spark protection screen positioned between said at least one outlet opening and said cover member and covering said at least one outlet opening.

14. A muffling device according to claim 13, wherein said cover member comprises bottom edge portions at said lateral walls and at a second end face opposite said main exhaust gas opening, wherein said bottom edge portions project outwardly past said spark protection screen.

15. A muffling device according to claim 14, wherein said bottom edges at said lateral walls of said cover member are connected to said at least one housing member by spot welds.

16. A muffling device according to claim 13, wherein said spark protection screen has an extension projecting outwardly from said cover member at said first end face and fastened to said at least one housing member by a screw.

* * * * *